US006710522B2

(12) United States Patent
Fransen

(10) Patent No.: US 6,710,522 B2
(45) Date of Patent: Mar. 23, 2004

(54) REFLECTOR LAMP WITH A SUPPORT BODY SURROUNDING THE REFLECTOR

(75) Inventor: Petrus Johannes Maria Fransen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 158 days.

(21) Appl. No.: 10/011,888

(22) Filed: Dec. 6, 2001

(65) Prior Publication Data

US 2002/0079797 A1 Jun. 27, 2002

(30) Foreign Application Priority Data

Dec. 11, 2000 (EP) ..... 00204433

(51) Int. Cl.[7] ..... H01J 5/48

(52) U.S. Cl. ..... 313/113; 313/110; 313/114; 313/115; 313/318.11; 362/546; 362/549; 362/296; 362/267; 362/226

(58) Field of Search ..... 313/113, 110, 313/114, 115, 318.11; 362/546, 296, 226, 267, 519, 547, 549

(56) References Cited

U.S. PATENT DOCUMENTS

| | | | | | |
|---|---|---|---|---|---|
| 4,682,274 | A | * | 7/1987 | Freudenreich et al. | 362/519 |
| 4,982,132 | A | | 1/1991 | Meyer et al. | 313/113 |
| 5,281,889 | A | | 1/1994 | Fields et al. | 313/113 |
| 5,402,325 | A | * | 3/1995 | Wisler et al. | 362/548 |
| 5,465,195 | A | * | 11/1995 | Jenner et al. | 362/523 |
| 5,651,603 | A | * | 7/1997 | Doring | 362/519 |
| 5,945,776 | A | * | 8/1999 | Koster et al. | 313/113 |
| 6,176,604 | B1 | * | 1/2001 | Dubrovin et al. | 362/539 |
| 6,210,020 | B1 | * | 4/2001 | Van Dulmen et al. | 362/226 |
| 6,454,436 | B1 | * | 9/2002 | Ilyes et al. | 362/226 |

FOREIGN PATENT DOCUMENTS

| | | | | |
|---|---|---|---|---|
| EP | 1055873 A2 | | 11/2000 | F21V/19/00 |
| FR | 2783594 A3 | | 3/2000 | F21V/19/00 |
| JP | 10228804 A | * | 8/1998 | F21M/3/02 |
| WO | WO0173341 | | 10/2001 | F21V/19/04 |

* cited by examiner

*Primary Examiner*—Vip Patel
*Assistant Examiner*—Sikha Roy

(57) ABSTRACT

The invention relates to a reflector lamp which comprises a reflector body (13) with a concave reflective part; an electric lamp (15) comprising a gastight lamp vessel with at least one end portion (18), an electric element (17) arranged in the lamp vessel, and a current conductor (19) extending through the end portion to the electric element; a support body (23) comprising reflector fastening means (30, 27) for fastening the support body to the reflector body, mechanical lamp vessel fastening means (43, 46) for fastening the support body to the end portion of the lamp vessel, and housing fastening means for fastening the support body inside the housing (2).

16 Claims, 4 Drawing Sheets

REFLECTOR LAMP WITH A SUPPORT BODY SURROUNDING THE REFLECTOR

FIELD OF THE INVENTION

The invention relates to a reflector lamp which comprises a reflector body with a concave reflecting portion and an electric lamp, comprising a closed lamp vessel with at least an end portion, an electric element arranged in the lamp vessel, and current conductors extending through the end portion to the electric element. The invention also relates to an assembly of a lamp housing, a reflector lamp provided therein, and control means for controlling the reflector lamp, and to a method of assembling the above.

BACKGROUND OF THE INVENTION

Reflector lamps are known in which the lamp vessel after alignment is fastened in that it is fixed in a neck formed at the concave reflector body by means of an adhesive agent (cement). This is disadvantageous because curing of the adhesive agent keeps the apparatus in which the lamp is aligned occupied during a considerably longer period than is necessary for the actual alignment. A further disadvantage is that the quality of the cement joint may deteriorate strongly owing to moisture absorption, which hampers the use of the reflector lamp in humid surroundings.

In addition, reflector lamps are known in which the lamp vessel is fastened to said neck of the reflector body by means of a mechanical fastening construction. Such a fastening construction is described, for example, in applicant's European patent application EU 1 055 873 A2 not previously published.

A disadvantage of the known reflector lamps is that the alignment of the lamp is effected before the lamp is placed in the lamp housing by means of a separate fastening. This may mean that the lamp turns out to be insufficiently aligned after being placed. In addition, such a construction is comparatively complicated.

It is an object of the present invention to provide an improved reflector lamp in which the above disadvantages have been counteracted.

SUMMARY OF THE INVENTION

According to a first aspect of the invention, the reflector lamp for this purpose comprises a support body comprising reflector fastening means for fastening the support body to the reflector body, mechanical lamp vessel fastening means for fastening the support body to the end portion of the lamp vessel, and housing fastening means for fastening the support body in a lamp housing. A combined lamp and reflector fastening is achieved thereby, with the result that the lamp remains sufficiently aligned when placed in a housing. In addition, the number of components of the construction is reduced, which leads to a simpler construction.

In a preferred embodiment of the invention, the support body is provided substantially around the reflector body, and the reflector fastening means comprise one or several abutment flanges on which the end face of the reflector body bears in axial direction, and resilient tags fastened to the support body, which tags engage the reflector body and urge the reflector body against the abutment flanges. Besides the advantage of a simple mounting of the reflector body in the support body, the positioning of the reflector body is retained in this embodiment.

Preferably, the reflector fastening means comprise three resilient tags positioned at substantially equal distances, whereby centering of the reflector body in the support body is promoted. To achieve a further improved centering of the reflector body, the reflector fastening means in addition comprise one or several tangential resilient portions for clamping the support body against the reflector body.

In a preferred embodiment, the housing fastening means comprise a number of resilient tags for clamping the support body (with the reflector body and lamp vessel fastened therein) in a lamp housing. The tags may be rigidly coupled to the lamp housing by means of welded and/or glued joints. In other preferred embodiments, the support body may be fastened to the lamp housing with clamping fit, or directly by means of a glued or welded joint.

According to another aspect of the invention, a reflector lamp is provided, preferably of the kind as described above, comprising:

a reflector body with a concave reflecting portion;

an electric lamp comprising a closed lamp vessel with a first and an opposed second end portion, an electric element arranged in the lamp vessel, and current conductors extending through the end portion to the electric element;

wherein an opening is provided in the concave portion of the reflector body so as to serve as a passage for the first end portion of the lamp vessel, and said end portion is fixed by means of a mechanical fastening construction positioned in the reflector body alongside the opening. The mechanical fastening construction here engages the first end portion of the lamp vessel in or immediately above the opening. The use of such a reflector body without a neck enables a stabler fastening of the lamp (burner), because the latter is fastened closer to the focal point. On the other hand, the reflector body shows fewer deformations owing to accumulations of material at the area of said opening, which improves the quality of directing of the light beam and makes the product simpler and accordingly less expensive. In addition, less material is used in the manufacture, and the fastening process is simpler.

Preferably, the mechanical fastening construction comprises means for aligning the lamp vessel and keeping it fixed in the aligned state. This provides an alignment of the lamp vessel.

The electric element of the lamp may be an incandescent body, possibly placed in an inert gas, or a pair of electrodes in an ionizable medium, for example in rare gas, or rare gas and mercury and/or sodium, in which case a high-pressure discharge is maintained during operation.

BRIEF DESCRIPTION OF THE DRAWING

Further advantages, characteristics, and details of the invention will be explained in more detail in the ensuing description of a preferred embodiment. The description is given with reference to the Figures, in which.

DETAILED DESCRIPTION OF THE PREFERRED EMBODIMENTS

Figure 1:
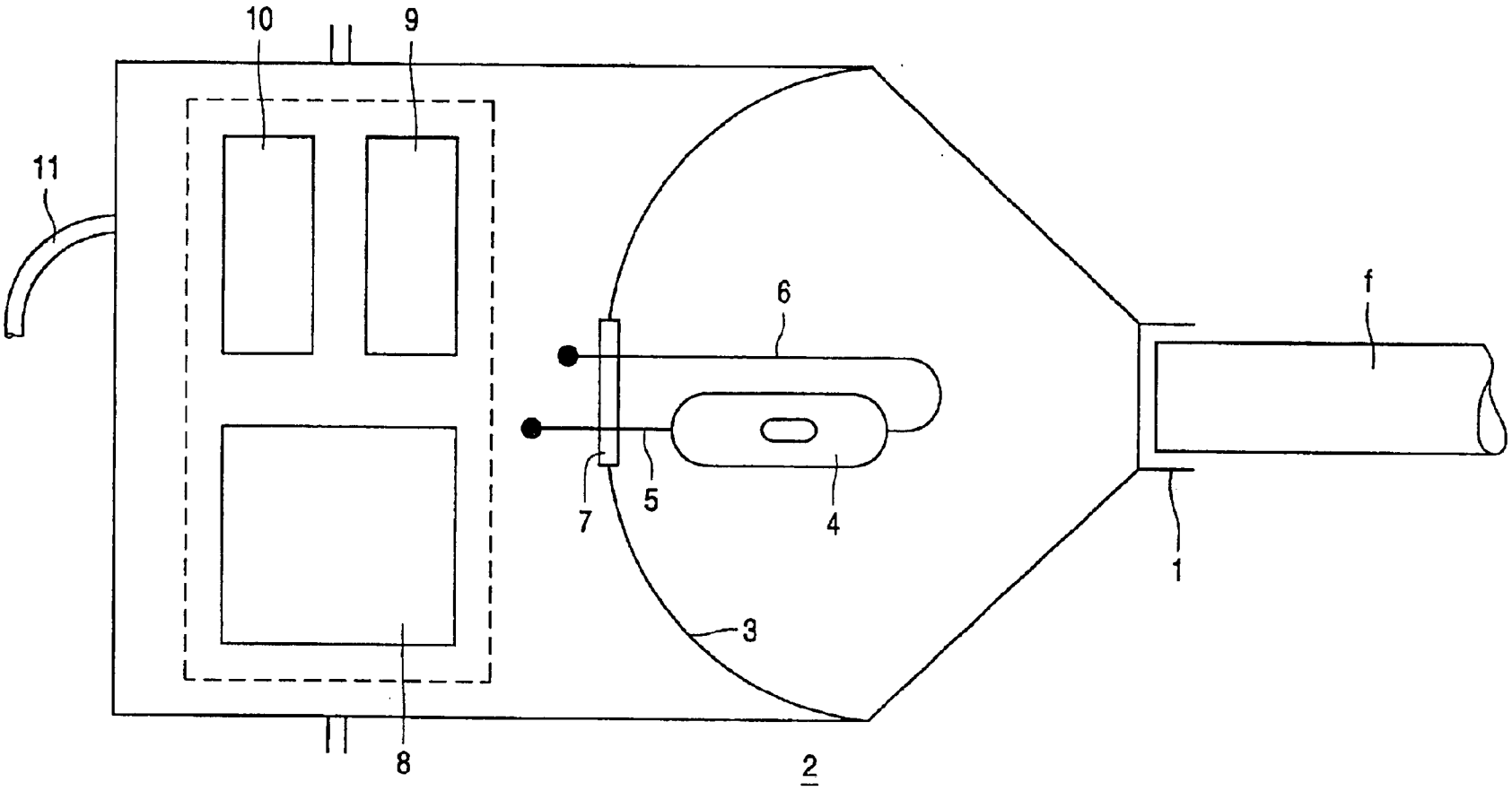
FIG. 1 is a diagrammatic view of a reflector lamp and the control arrangements belonging thereto, both provided in a lamp housing.

FIG. 1 shows a light generator for introducing a light beam into a glass fiber cable f, for example for use in the automobile industry. In an alternative embodiment, for example, reflector lamps may be used in a projection television (beamer).

In the embodiment shown, the glass fiber cable f is connected to a lamp housing 2 via a coupling piece 1. A concave reflector body 3 is provided in the lamp housing 2, which body is provided on its inner surface with a reflecting coating, for example of metal such as aluminum or silver. An electric lamp 4 is connected to electric current conductors 5 and 6 and is fixed in the lamp housing 2 by means of a fastening 7. The lamp 4 can be controlled in a known manner by a starter 9, an error detector 10, and further control electronics or ballast 8. The assembly is connected to an electrical supply source (not shown) by means of a cord 11.

Figure 2:
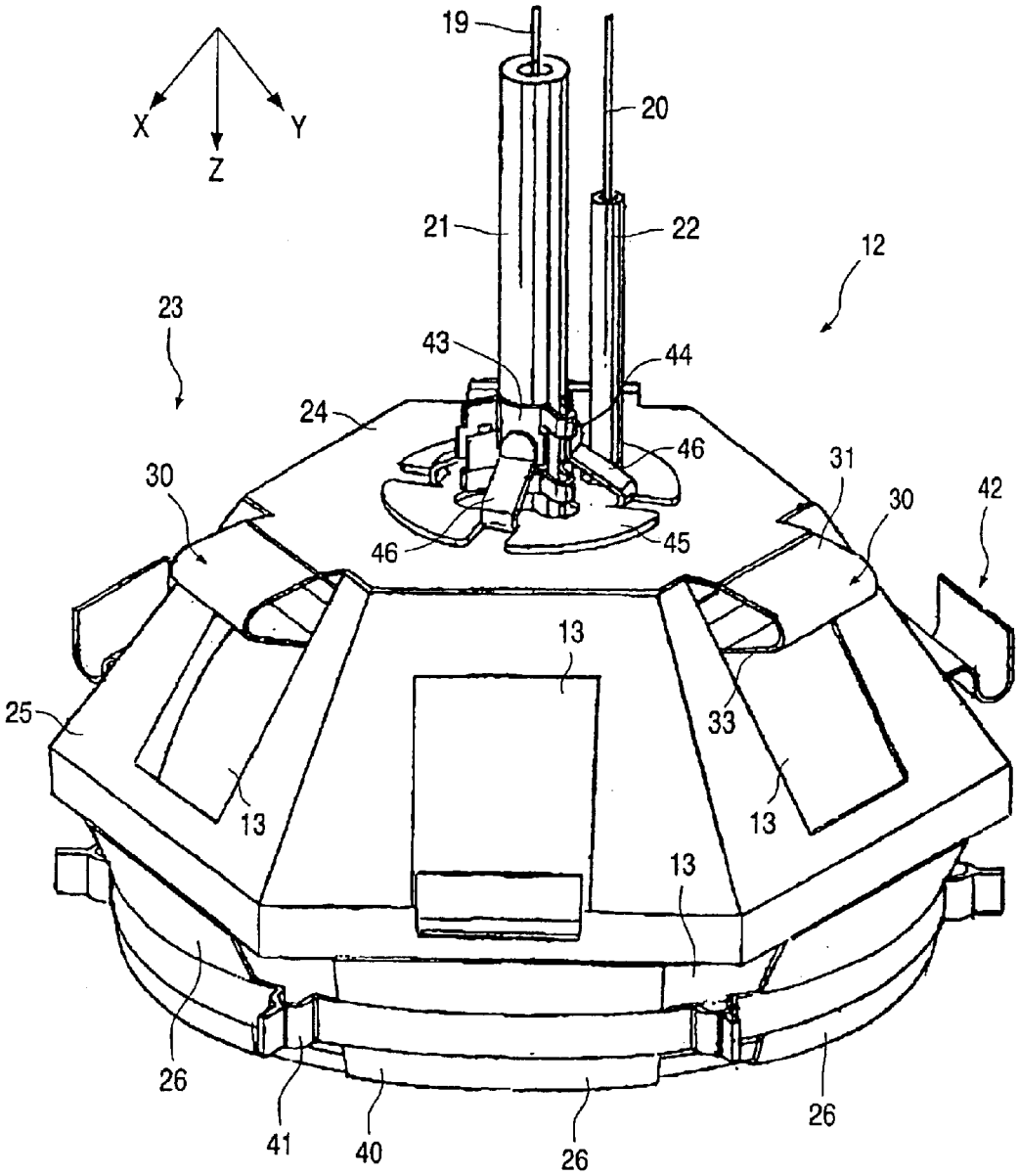
FIG. 2 is a lateral perspective view of the preferred embodiment of the invention.
Figure 3:
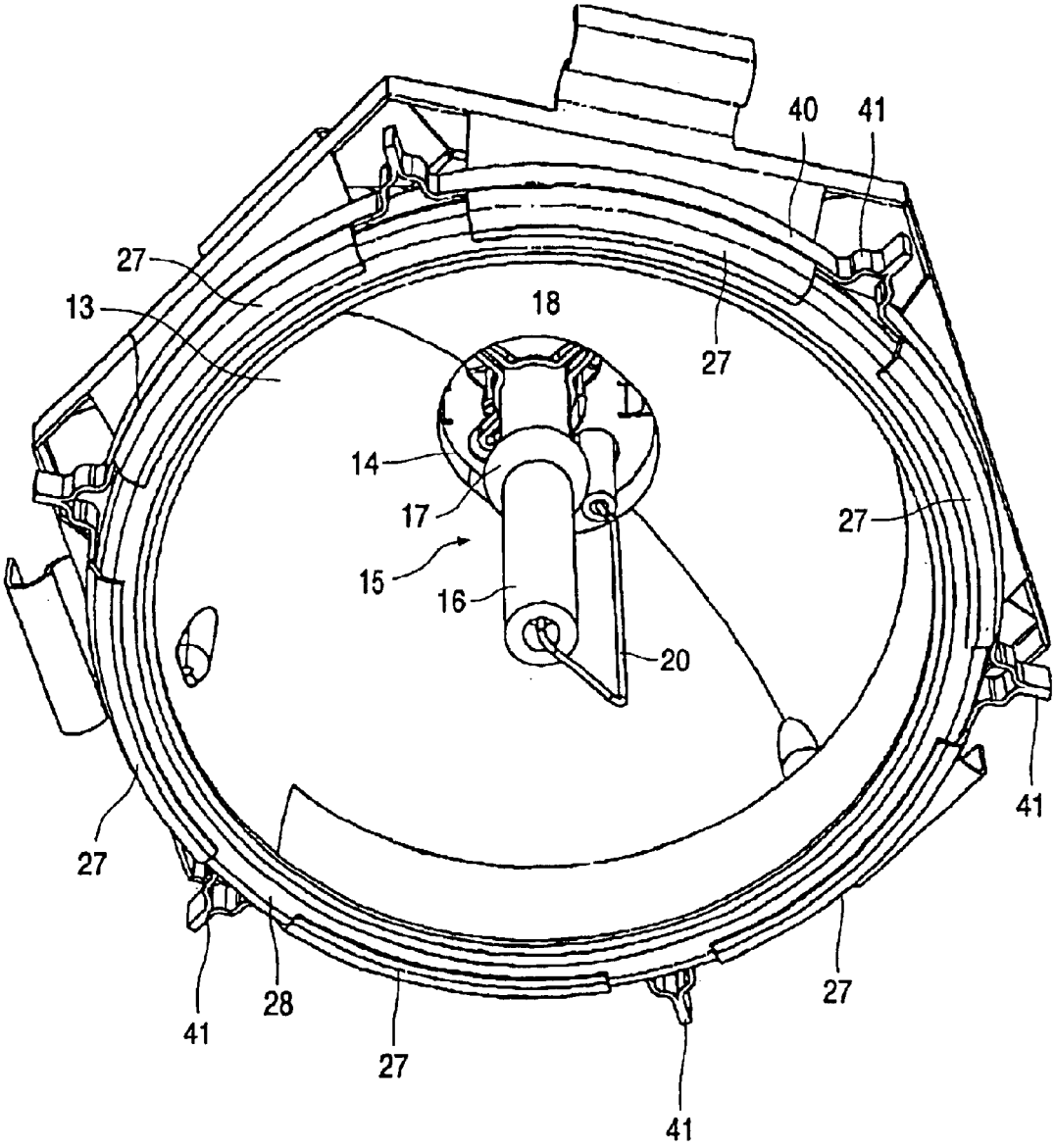
FIG. 3 is a perspective bottom view of the preferred embodiment of FIG. 2.
Figure 4:
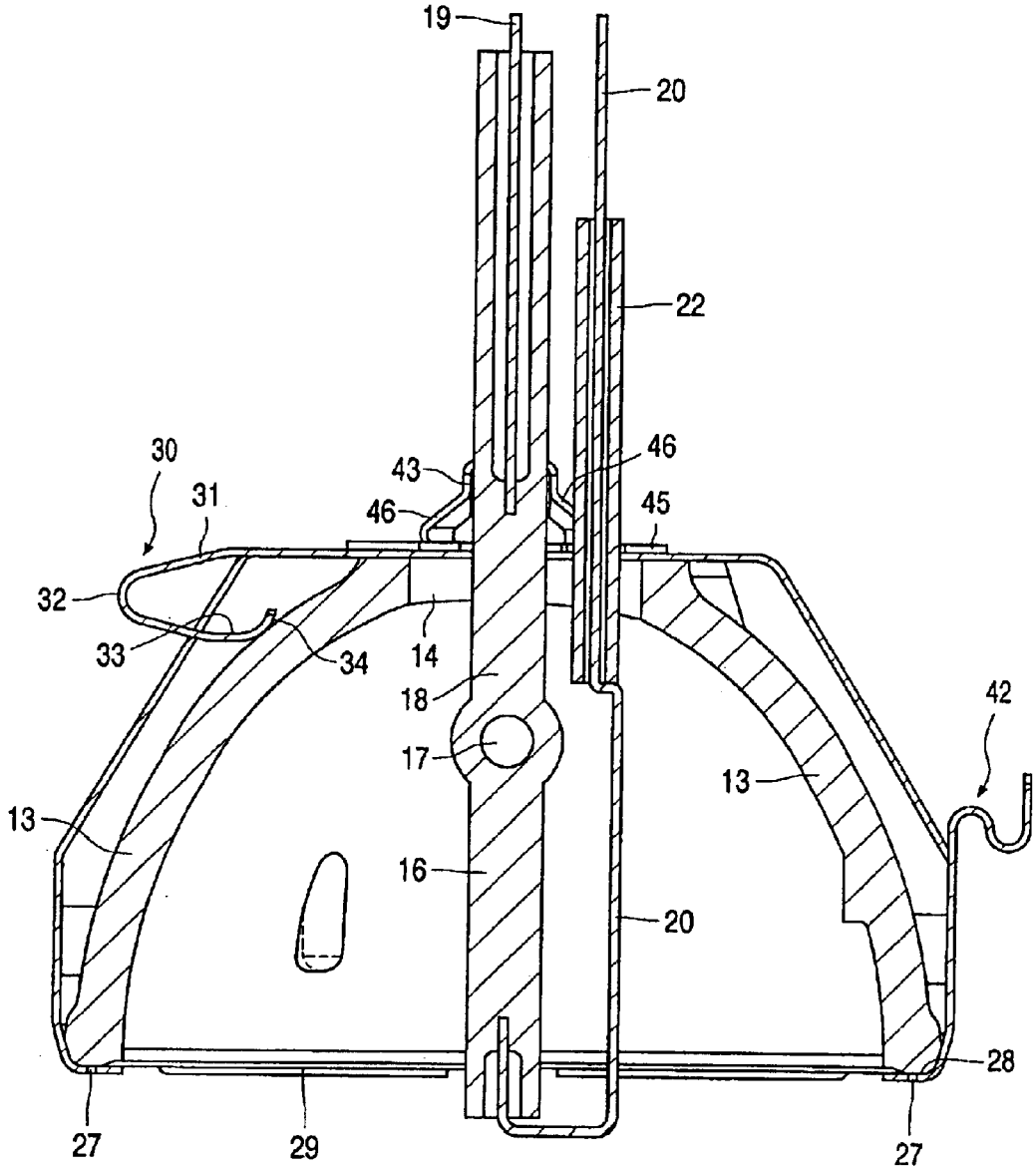
FIG. 4 is a cross-sectional view of the preferred embodiment of FIGS. 2 and 3.

FIGS. 2, 3, and 4 show a preferred embodiment of a reflector lamp 12. The lamp comprises a concave reflector body 13, an opening 14 being provided in the top of this body. An electric lamp 15 with a lamp vessel closed in a vacuumtight manner is provided in the reflector body 13. A first end portion 18 of the lamp vessel extends through the opening 14, while the opposed second end portion 16 lies substantially on the axis of symmetry or optical axis of the reflector body 13. The electric element 17 is present in the lamp vessel, and current conductors 19 and 20 extend through the first end portion 18 and the second end portion 16, respectively, to the electric element 17. The current conductors 19 and 20 are provided with protective sleeves 21 and 22 in the locations where they pass through the opening 14 in the reflector body 13.

A support body 23, preferably made of metal, is provided for a combined fastening of the lamp vessel to the reflector and of the reflector to a lamp housing, if present. The support body comprises an upper wall 24 to which a suspended wall 25 is fastened. A number of tags 26 is provided at the lower side of the suspended wall 25, which tags are bent at their lower ends so as to form abutment flanges 27 on which the end face 28 of the reflector body 13 can bear in the mounted state.

The suspended wall 25 has been cut open in eight locations so as to obtain four resilient tags 30 for fastening the support body 23 to the reflector body 13, and four resilient tags for fastening the support body 23 to the lamp housing (not shown).

The cross-sectional view in FIG. 4 shows how a resilient tag 30 is built up from a portion 31 which extends radially outwards and which merges into a tag 34 via a curved portion 32 and a portion 33 extending radially inwards. This construction is such that each of the tags 34 force the reflector body 13 provided in the support body in downward direction, (the direction indicated by an arrow) against the abutment flanges 27. The reflector body 13 remains fixed to the support body 23 as a result of this.

Preferably, a metal strip 40 is provided around the tags 26, which strip is given resilient portions 41 in a number of locations. The spring force of the resilient portions 41 ensures that the tags 26 are urged inwards such that the abutment flanges 27 remain correctly positioned below the end face 28 of the reflector body 13. This is of importance especially in view of the difference in coefficient of thermal expansion between the metal support body 23 and the cover glass 29 with which the reflector body 13 is closed off. Differences in expansion between the glass and the metal parts arranged around it are compensated in that the strip 40, and accordingly the tags 26, are given a certain bias tension.

In addition, the above construction of tags 26 and 30, whether or not in combination with said metal strip 40, ensures that the reflector body 13 remains correctly centered with respect to the support body 23.

To fasten the support body 23 to the lamp housing, a number of resilient tags 42 is provided at the support body 23. These tags are S-shaped in the embodiment shown. The tags may have an alternative shape or construction, in dependence on the lamp housing used.

The support body 23 with the other parts of the reflector lamp fastened thereto can be fixedly clamped in the lamp housing by means of the resilient tags 42. In some applications, the tags 42 are subsequently fixed to the lamp housing by means of welded joints and/or glue connections.

There are several possibilities for mechanically fastening the end portion 18 to the upper wall 24 of the support body 23. In the embodiment shown, a plate 45 is fixed on the upper wall 24, in which plate 45 two openings are provided for the end portion 18 and for the current conductor 22, respectively. Four resilient tongues 46 bent in upward direction are cut from the plate 45. In an alternative embodiment which is not shown, the plate 45 is omitted, and the resilient tongues are formed directly from the upper wall 24 of the support body 23. A clamp 43 is fastened to the end portion 18. The clamp 43 is provided with radially extending projections 44 in three positions which correspond to those of the tongues 46. The projections 44 are each provided with a recess in which the upper side of the associated tongue 46 can be enclosed. The desired position of the lamp vessel in the Z-direction can be laid down by clamping the clamp 43 to the end portion 18 in a correct position In addition, the position of the lamp vessel in the XY-directions can be defined through bending of the tongues 46. The lamp can be aligned in a simple manner by means of the mechanical construction described.

It is also conceivable to align the lamp first, and then to weld the plate 45 to the upper wall 24 of the support body 23 in a suitable position and fasten the lamp to the plate 45.

Alternative constructions are possible in addition to the constructions described above. Thus the lamp vessel may be fastened to the reflector body 13 or to the support body 23 by means of a spring cup. This embodiment has the advantage that fewer components are required.

The usual neck of the reflector body has been omitted in all mechanical fastening constructions according to the invention. The absence of the neck renders it possible to fasten the lamp at a smaller distance from the focal point, which makes the fastening more stable.

What is claimed is:

1. A reflector lamp comprising:

a reflector body (13) with a concave reflecting portion;

an electric lamp (15) comprising a closed lamp vessel with at least an end portion (18), an electric element (17) arranged in the lamp vessel, and a current conductor (19) extending through the end portion to the electric element; and a support body (23) dimensioned to receive and surround a major portion of the reflector body (13), said support body (23) comprising reflector fastening means (30, 27) for contacting a circular edge of the concave reflector body (13) and for fastening the support body to the reflector body, mechanical lamp vessel fastening means (43, 46) for fastening the support body to the end portion of the lamp vessel, and housing fastening means (42) for fastening the support body in a lamp housing (2).

2. A reflector lamp as claimed in claim 1, wherein the support body (23) is fastened to the concave portion of the reflector body.

3. A reflector lamp as claimed in claim 1, wherein the support body (23) is provided substantially around the reflector body (13), and the reflector fastening means comprise one or several abutment flanges (27) on which end face (28) of the reflector body (13) bears in axial direction, and resilient tags (30) fastened to the support body, which tags engage the reflector body and urge the reflector body against the abutment flanges (27).

4. A reflector lamp as claimed in claim 3, wherein the reflector fastening means comprise three resilient tags (30) positioned at substantially equal distances.

5. A reflector lamp as claimed in claim 3, wherein the reflector fastening means in addition comprise one or several tangential resilient portions (41) for clamping the support body (23) against the reflector body (13).

6. A reflector lamp as claimed in claim 5, wherein the tangential resilient portions (41) are provided adjacent the end face (28) of the reflector body.

7. A reflector lamp as claimed in claim 1, wherein the housing fastening means comprise a number of resilient tags (42) for clamping the support body in the lamp housing (2).

8. A reflector lamp as claimed in claim 7, wherein the resilient tags (42) are welded or glued to the lamp housing in the clamped-in state.

9. A reflector lamp as claimed in claim 1, wherein the support body (23) is manufactured from one piece of metal.

10. A reflector lamp, comprising:

a reflector body (13) with a concave reflecting portion;

an electric lamp (15) comprising a closed lamp vessel with a first (18) and an opposed second end portion (16), an electric element (17) arranged in the lamp vessel, and current conductors extending through the end portions (16, 18) to the electric element; and a support body (23) dimensioned to receive and surround a major portion of the reflector body (13), said support body (23) comprising reflector fastening means (30, 27) for contacting a circular edge of the concave reflector body (13) and for fastening the support body (23) to the reflector body (13);

wherein an opening (14) is provided in the concave portion of the reflector body (13) so as to serve as a passage for the first end portion (18) of the lamp vessel, and said end portion is fixed by means of a mechanical fastening construction positioned in the reflector body alongside the opening (14).

11. A reflector lamp as claimed in claim 10, wherein the mechanical fastening construction engages the first end portion of the lamp vessel in or immediately above the opening.

12. A reflector lamp as claimed in claim 11, wherein the mechanical fastening construction comprises means (43, 46) for aligning the lamp vessel and fixing it in the aligned state.

13. A reflector lamp as claimed in claim 10, wherein the mechanical fastening construction comprises a spring cup.

14. A reflector lamp as claimed in claim 10, wherein the mechanical fastening construction comprises a clamp (43) gripping the lamp vessel and a number of resilient tags (46) which engage with the clamp.

15. An assembly comprising: a lamp housing (2); control means (8, 9, 10) provided in the lamp housing; and one or several reflector lamps as claimed in claim 1 provided in the lamp housing and connected to the control means (8, 9, 10).

16. A method of joining together an assembly as claimed in claim 15, which method comprises the steps of: connecting the support body to the reflector body; connecting an end of the lamp vessel to the support body; fastening the support body in the lamp housing; and aligning the lamp in the fastened state.

* * * * *